United States Patent [19]

Nissen et al.

[11] 4,389,773

[45] Jun. 28, 1983

[54] SHAVING IMPLEMENT

[75] Inventors: Warren I. Nissen, Topsfield; Richard J. Petrillo, Norwell, both of Mass.

[73] Assignee: The Gillette Company, Boston, Mass.

[21] Appl. No.: 258,936

[22] Filed: Apr. 30, 1981

[51] Int. Cl.[3] ..... B26B 21/02

[52] U.S. Cl. ..... 30/50; 30/32; 30/47; 30/337; 30/346.5

[58] Field of Search ..... 30/32, 50, 346.5, 47, 30/337

[56] References Cited

U.S. PATENT DOCUMENTS

| | | | |
|---|---|---|---|
| 840,244 | 1/1907 | Odell . | |
| 1,048,696 | 12/1912 | Horton | 30/32 X |
| 1,738,032 | 12/1929 | Behrman et al. . | |
| 1,877,758 | 9/1932 | Kylberg . | |
| 1,923,439 | 8/1933 | Hukill | 30/12 |
| 2,056,408 | 10/1936 | Ohmer | 30/50 |
| 2,155,749 | 4/1939 | Young et al. | 30/62 |
| 2,605,545 | 8/1952 | Weems | 30/337 |
| 2,799,927 | 7/1957 | Beham | 30/66 |
| 3,600,804 | 8/1971 | Brown | 30/32 |
| 3,771,223 | 11/1973 | Dawidowicz | 30/40 |
| 4,063,354 | 12/1977 | Oldroyd et al. | 30/50 X |
| 4,146,958 | 4/1979 | Chen et al. | 30/47 |
| 4,168,571 | 9/1979 | Francis | 30/50 X |
| 4,324,041 | 4/1982 | Trotta | 30/50 X |

FOREIGN PATENT DOCUMENTS

| | | |
|---|---|---|
| 582229 | 8/1931 | Fed. Rep. of Germany . |
| 2358203 | 11/1973 | Fed. Rep. of Germany . |
| 2624613 | 6/1976 | Fed. Rep. of Germany . |
| 2055069 | 2/1981 | United Kingdom . |

*Primary Examiner*—James G. Smith
*Assistant Examiner*—Debra S. Meislin
*Attorney, Agent, or Firm*—Scott R. Foster

[57] ABSTRACT

A shaving implement comprising a platform member having a slot therein and a support surface adjacent the slot, a blade member having first and second portions generally normal to each other, the first portion having a cutting edge thereon, and a cap member having a support surface thereon, the blade member second portion being disposed in the slot and the blade member first portion being clamped between the platform and cap member support surfaces, the cap member being permanently joined to the platform member.

12 Claims, 3 Drawing Figures

SHAVING IMPLEMENT

BACKGROUND OF THE INVENTION

1. Field of the Invention

The Invention relates to shaving implements, and is directed more specifically to an implement in which blade means are permanently secured between platform and cap means.

2. Description of the Prior Art

Shaving implements of the type in which blade means are permanently fixed between platform and cap members are disclosed in U.S. Pat. No. 3,703,764, issued Nov. 28, 1972 to Roger L. Perry and U.S. Pat. No. 3,724,070, issued Apr. 3, 1973 to Francis W. Dorion, Jr. Such constructions include planar blade members and means associated with the platform and/or cap members for properly positioning the blade means therebetween. In embodiments in which the blade means comprise more than a single blade, there has usually been a spacer member adapted to maintain the proper separation between the blades.

SUMMARY OF THE INVENTION

It is an object of the present invention to provide a shaving implement of the type above described including positive means for locating and retaining blade means between platform and cap members permanently joined together.

With the above and other objects in view, as will hereinafter appear, a feature of the present invention is the provision of a shaving implement comprising a platform member having slot means therein and support means adjacent the slot means, the support means having thereon support surface means generally normal to the slot means, blade means comprising a blade member having first and second portions generally normal to each other, the first portion having a cutting edge thereon, and a cap member having support means, the cap member support means having thereon support surface means, the blade member second portion being disposed in the slot means, the blade member first portion being clamped between the platform member support surface means and the cap member support surface means, the cap member being permanently joined to said platform member.

The above and other features of the invention, incuding various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
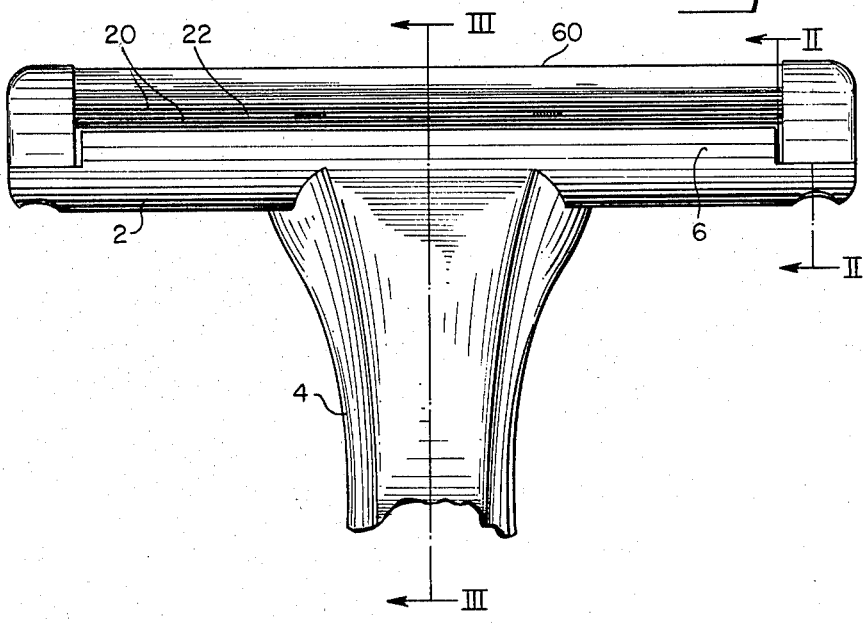
FIG. 1 is a front elevational view of one form of shaving implement illustrative of an embodiment of the invention.
Figure 2:
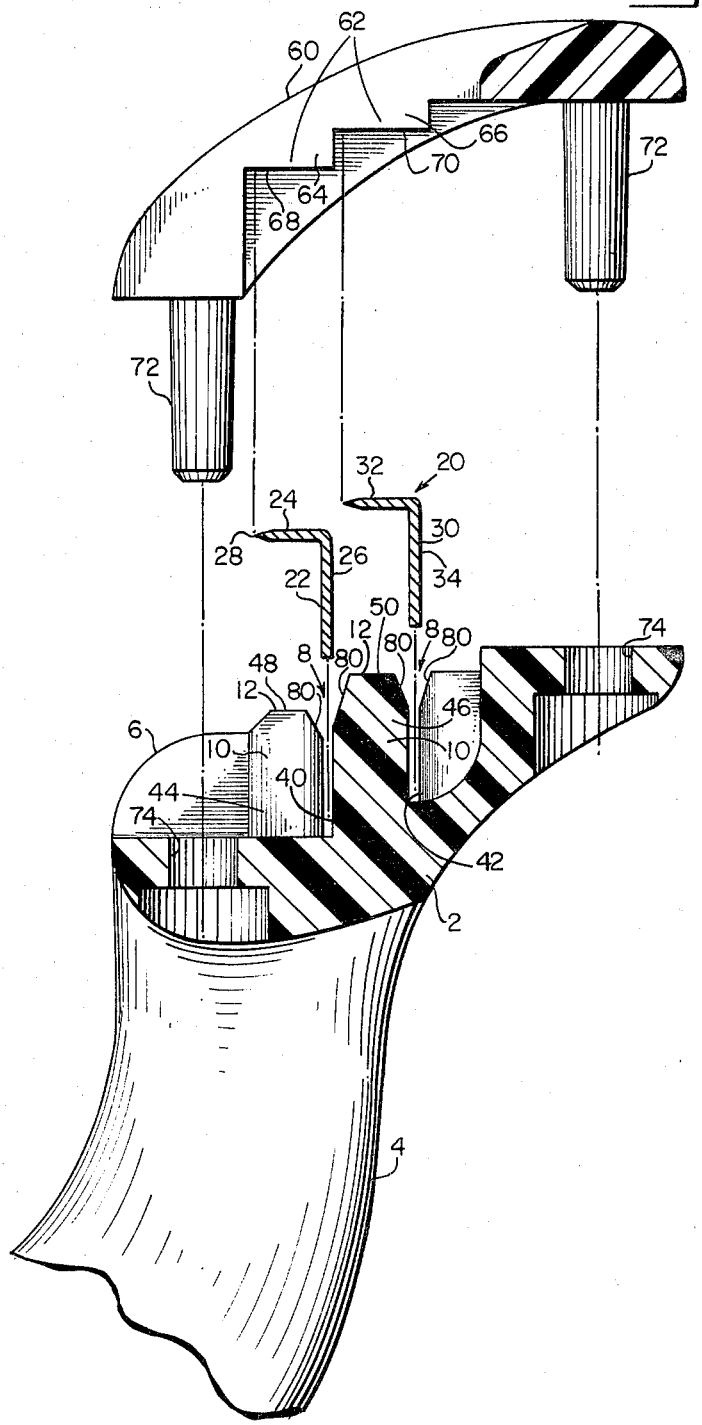
FIG. 2 is a sectional exploded view, the section being taken along line II—II of FIG. 1.

Referring to the drawings, it will be seen that the illustrative shaving implement includes a platform member 2 which may, as illustrated, comprise a portion of a handle 4, or may be provided with means for attachment to and removal from a handle, as is well known in the art. The platform member 2 is provided with a guard portion 6 which, in a shaving operation, precedes the cutting means in movement across the surface being shaved. The platform member 2 is further provided with slot means 8 and support means 10 adjacent the slot means, the support means having support surface means 12 generally normal to the slot means 8. The support means 10 may form the slot means 8, or a portion thereof, as best seen in FIG. 2.

Blade means 20 include a blade member 22 having first and second portions 24, 26 generally normal to each other. The first blade portion 24 is provided with a cutting edge 28. The second blade portion 26 is received in the slot means 8 of the platform member 2.

The blade means 20 may, as illustrated, include a second blade member 30 having first and second portions 32, 34 generally normal to each other, the first blade portion 32 being provided with a cutting edge 36, and the second blade portion 34 being received in the slot means 8 of the platform member 2, which in the case of two blades, comprises first and second slots 40, 42.

In a two-blade embodiment, the platform member support means 10 includes first and second support means 44, 46 having, respectively, support surfaces 48, 50, the second support means 46 extending further than the first support means 44, to place the support surfaces 48, 50 in removed planes. In such instance, the first slot 40 is formed by the first and second support means 44, 46 and the second slot 42 is formed in part by the second support means 46.

The first and second support means 44, 46 may comprise a plurality of upstanding projections having their respective support surfaces 48, 50 at the free ends thereof.

The shaving implement further includes a cap member 60 provided with support means 62 which, in the illustrative embodiment, includes first support means 64 and second support means 66 having, respectively, first and second support surfaces 68, 70 (FIG. 2). The first support means 64 extends further toward the platform member than does the second support means 66. The cap member is provided with posts 72 which are disposed along first and second lengthwise margins thereof, the first margin being the front margin of the cap member and the second margin being the rearward margin of the cap member, shown on the left and right, respectively, in FIG. 2. The posts 72 are received in holes 74 in the platform member which are disposed along first and second lengthwise margins thereof, the first margin being the front margin of the platform member and the second margin being the rearward margin of the platform member, shown on the left and right, respectively, in FIG. 2. The posts 72 are headed over to permanently fix the assembly together. The cap member 60 is provided at either end thereof with end walls depending therefrom, one of which is illustrated in FIG. 2.

The first portion 24 of the first blade member 22 is clamped permanently and immovably between the platform member first support surface 48 and the cap member first support surface 68. In like manner, the second blade member 30 is clamped permanently and immovably between the platform member second support surface 50 and the cap member second support surface 70.

Figure 3:
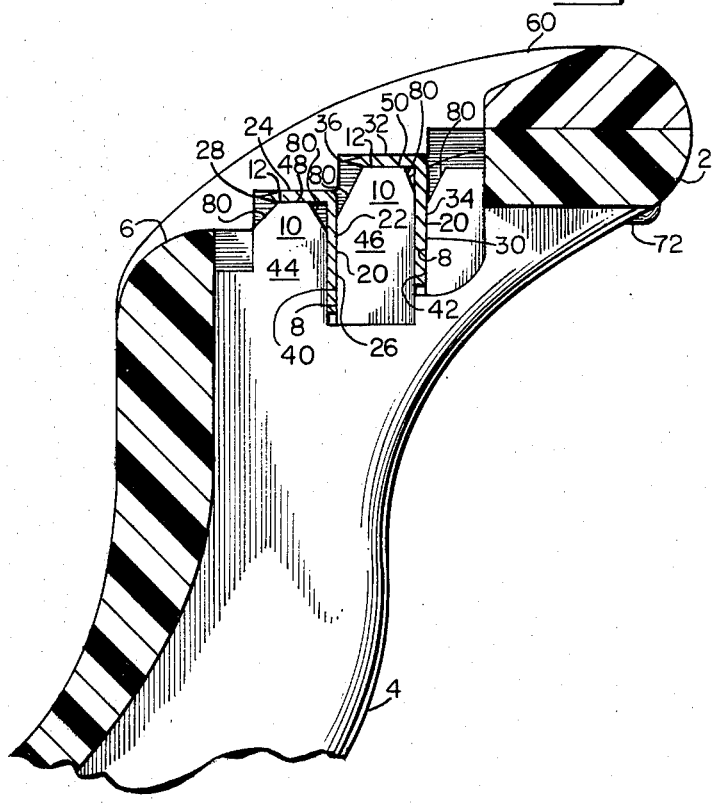
FIG. 3 is a sectional view, taken along line III—III of FIG. 1.

As may be seen in FIGS. 2 and 3, planes of the cap member support surfaces 68, 70 and planes of the platform member support surfaces 48, 50 are respectively parallel, the planes 48, 68 and 50, 70 being respectively separated from each other by a distance substantially equal to a thickness of a blade member first portion 24, 32.

Thus, in assembly, the blades 22, 30 are easily positioned by insertion of the blade portions 26, 34 in the slots 40, 42 and are clamped and held firmly in place by support surfaces 48 and 68, and 50 and 70, respectively. To aid in easily and rapidly positioning the blades in the slots, the platform support means 44, 46 and the platform member 2, may be provided with bevelled surfaces 80 defining entryways. in assembled disposition, the ends of the blades are proximate and within the cap member end walls.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. A shaving implement comprising a platform member having slot means therein and support means adjacent said slot means, said support means having thereon support surface means generally normal to said slot means, blade means comprising a blade member having first and second portions generally normal to each other, said first portion having a cutting edge thereon, and a cap member having support means, said cap member support means having thereon support surface means, said blade member second portion being disposed in said slot means, said blade member first portion being clamped permanently and immovably between said platform member support surface means and said cap member support surface means, said cap member being permanently joined to said platform member.

2. The shaving element in accordance with claim 1 in which said blade means includes a second blade member having first and second portions generally normal to each other, said second blade first portion having a cutting edge thereon, said slot means comprises first and second slots, said first slot having said first blade second portion disposed therein and said second slot having said second blade second portion disposed therein, said platform member support means comprising first and second platform member support means having, respectively, first and second platform member support surfaces, and said cap member support means comprising first and second cap member support means having, respectively, first and second cap member support surfaces, said first blade member first portion being clamped between said platform member first support surface and said cap member first support surface, and said second blade member first portion being clamped permanently and immovably between said platform member second support surface and said cap member second support surface.

3. The shaving element in accordance with claim 2 in which said platform member first and second support surfaces are in different planes to retain said first and second blade first portions in off-set relationship, whereby in a shaving operation said first blade cutting edge precedes said second blade cutting edge in movement over a surface being shaved.

4. The shaving implement in accordance with claim 3 in which said first and second slots are formed in part by said platform member first and second support means.

5. The shaving implement in accordance with claim 4 in which said first slot is formed by said platform member first and second support means, and said second slot is formed in part by said platform member second support means.

6. The shaving element in accordance with claim 5 in which said platform member first and second support means each comprise a plurality of posts upstanding from said platform portion, said first and second platform member first and second support surfaces being, respectively, on the free ends of said posts.

7. A shaving implement comprising a platform member having a guard portion disposed at a first lengthwise margin thereof and a cap support portion disposed at a second lengthwise margin thereof, said margins having holes therein, said platform member having slot means therein and support means adjacent said slot means, said support means having thereon support surface means generally normal to said slot means, blade means comprising a blade member having first and second planar portions generally normal to each other, said first portion having a cutting edge thereon, said platform member having bevelled surfaces thereon disposed so as to define entryway means for said slot means, and a cap member having support means, said cap member support means having thereon support surface means, said cap member having posts extending therefrom and received in said holes to interconnect said platform and cap portions along said margins, said cap member having end walls depending therefrom at either end thereof, respectively, said blade member second portion being disposed in said slot means, said blade member first portion being clamped permanently and immovably between said platform member support surface means and said cap member support surface means, ends of said blade means being proximate and within said cap member end walls, said cap member being permanently joined to said platform member by heading over of said posts in said holes.

8. The shaving implement in accordance with claim 7 in which said blade means includes a second blade member having first and second portions generally normal to each other, said second blade first portion having a cutting edge thereon, said slot means in said platform comprises first and second slots, said first slot having said first blade second portion disposed therein and said second slot having said second blade second portion disposed therein, said bevelled surfaces defining entryways for said first and second slots, said platform member support means comprising first and second platform member support means integral with and extending from said platform member and having, respectively, first and second platform member support surfaces, and said cap member support means comprising first and second cap member support means having, respectively, first and second cap member support surfaces, said first blade member first portion being clamped permanently and immovably between said platform member first support surface and said cap member first support surface, and said second blade member first portion being clamped permanently and immovably between said platform second support surface and said cap member second support surface.

9. The shaving implement in accordance with claim 8 in which said first and second platform member support means are of a different height whereby to locate said first and second support surfaces in different planes to retain said first and second blade first portions in off-set relationship, whereby in a shaving operation said first blade cutting edge precedes said second blade cutting edge in movement over a surface being shaved.

10. A shaving implement comprising a platform member having slot means therein and support means adjacent said slot means, said support means being integral with and extending from said platform member and having thereon support surface means generally normal to said slot means, blade means comprising a blade member having first and second portions generally normal to each other, said first portion having a cutting edge thereon, and a cap member having support means, said cap member support means having thereon support surface means, said blade member second portion being disposed in said slot means, a plane of said cap member support surface means and a plane of said platform member support surface means being parallel, said planes being separated from each other by a distance substantially equal to a thickness of said blade member first portion, said blade member first portion being disposed and clamped permanently and immovably between said platform member support surface means and said cap member support surface means, said cap member being permanently joined to said platform member.

11. A shaving implement comprising a platform member having a guard portion disposed at a first lengthwise margin thereof and a cap support portion disposed at a second lengthwise margin thereof, said margins having holes therein, said platform member having slot means therein and support means adjacent said slot means, said support means being integral with and an extension from said platform member and having thereon support surface means generally normal to said slot means, blade means comprising a blade member having first and second planar portions generally normal to each other, said first portion having a cutting edge thereon, said platform member having bevelled surfaces thereon disposed so as to define entryway means for said slot means, and a cap member having support means, said cap member support means having thereon support surface means, said cap member having posts extending therefrom and received in said holes to interconnect said platform and cap portions along said margins, said cap member having end walls depending therefrom at either end thereof, respectively, said blade member second portion being disposed in said slot means, a plane of said cap member support surface means and a plane of said platform member support surface means being parallel, said planes being separated from each other by a distance substantially equal to a thickness of said blade member first portion, said blade member first portion being disposed and clamped permanently and immovably between said platform member support surface means and said cap member support surface means, ends of said blade means being proximate and within said cap member end walls, said cap member being permanently joined to said platform member by heading over of said posts in said holes.

12. A shaving implement comprising a platform member having a guard portion disposed at a first lengthwise margin thereof and a cap support portion disposed at a second lengthwise margin thereof, said margins having holes therein, said platform member having first and second slots therein and first and second platform member support means integral with and extending from said platform member and having, respectively, first and second platform member support surfaces adjacent, respectively, said slots, said support surfaces being generally normal to said slots, blade means comprising a first blade member having first and second planar portions generally normal to each other, and a second blade member having first and second planar portions generally normal to each other, said blade first portions having cutting edges thereon, said first slot having said first blade second portion disposed therein and said second slot having said second blade second portion disposed therein, said platform member having bevelled surfaces thereon disposed so as to define entryway means for said first and second slots, and a cap member having first and second cap member support surfaces, said first blade member first portion being clamped immovably between said platform member first support and said cap member first support surface, and said second blade member first portion being clamped immovably between said platform second support surface and said cap member second support surface, said cap member having posts extending therefrom and received in said holes to interconnect said platform and cap portions along said margins, said cap member having end walls depending therefrom at either end thereof, respectively, ends of said blade means being proximate and within said cap member end walls, said cap member being permanently joined to said platform member by heading over of said posts in said holes.

* * * * *

UNITED STATES PATENT AND TRADEMARK OFFICE

CERTIFICATE OF CORRECTION

PATENT NO. : 4,389,773

DATED : June 28, 1983

INVENTOR(S) : Warren I. Nissen and Richard J. Petrillo

It is certified that error appears in the above-identified patent and that said Letters Patent are hereby corrected as shown below:

Column 3, line 51, "element" should be -- implement --.

Column 3, line 66, after "clamped" insert -- permanently and immovably --.

Column 4, line 4, "element" should be -- implement -- .

Column 4, line 19, "element" should be -- implement --.

Column 6, line 41, after"support" insert -- surface --.

Signed and Sealed this

*Twenty-ninth* Day of *November 1983*

[SEAL]

*Attest:*

GERALD J. MOSSINGHOFF

*Attesting Officer*

*Commissioner of Patents and Trademarks*